US008490764B2

(12) United States Patent
Simester

(10) Patent No.: US 8,490,764 B2
(45) Date of Patent: Jul. 23, 2013

(54) PORTABLE STORAGE AND CHANGING STATION

(76) Inventor: Margaret Simester, Issaquah, WA (US)

( * ) Notice: Subject to any disclaimer, the term of this patent is extended or adjusted under 35 U.S.C. 154(b) by 670 days.

(21) Appl. No.: 12/156,200

(22) Filed: May 30, 2008

(65) Prior Publication Data

US 2008/0296110 A1 Dec. 4, 2008

Related U.S. Application Data

(60) Provisional application No. 60/932,388, filed on May 30, 2007.

(51) Int. Cl.

| | |
|---|---|
| ***A45C 5/14*** | (2006.01) |
| ***A45C 7/00*** | (2006.01) |
| ***A45C 9/00*** | (2006.01) |
| ***A45C 13/00*** | (2006.01) |

(52) U.S. Cl.
USPC ..... 190/1; 190/14; 190/18 A; 206/279; 206/282; 312/6

(58) Field of Classification Search
USPC ..... 190/1, 14, 18 A, 24; 4/599; 135/4, 135/95; 312/6; 206/279, 281, 282, 283.1, 206/283, 315.1
See application file for complete search history.

(56) References Cited

U.S. PATENT DOCUMENTS

| | | | | |
|---|---|---|---|---|
| 420,668 | A | 2/1890 | Wallace | |
| 1,251,245 | A * | 12/1917 | Kulier | 312/6 |
| 1,844,038 | A * | 2/1932 | Hooker | 4/599 |
| 1,925,467 | A | 9/1933 | Sinning | |
| 2,116,197 | A * | 5/1938 | Gersten | 206/283 |
| 2,128,099 | A * | 8/1938 | Marks | 206/283 |
| 2,584,432 | A * | 2/1952 | De Marco | 135/95 |
| 2,633,979 | A * | 4/1953 | Warnick | 206/291 |
| 2,652,845 | A * | 9/1953 | O'Neill et al. | 135/90 |
| 2,684,150 | A * | 7/1954 | Kroner | 206/283 |
| 2,781,766 | A * | 2/1957 | Krieger | 135/145 |
| 2,893,545 | A | 7/1959 | Garfunkel | |
| 3,208,083 | A | 9/1965 | Witczak | |
| 3,437,181 | A * | 4/1969 | Blount, Jr. | 190/111 |
| D215,161 | S | 9/1969 | Schickel | D33/1 |
| 3,679,280 | A * | 7/1972 | Friederich et al. | 312/6 |
| 4,126,213 | A * | 11/1978 | McDonald | 190/18 A |
| 4,421,260 | A | 12/1983 | DeVore | 224/42.43 |
| 4,442,927 | A * | 4/1984 | Walker | 190/18 A |
| 4,592,472 | A * | 6/1986 | Carnera | 211/119.01 |
| 4,887,837 | A | 12/1989 | Bonewicz, Jr. et al. | 280/654 |
| D328,529 | S | 8/1992 | Lenarczyk | D6/329 |
| 5,377,849 | A * | 1/1995 | Martin | 211/85.7 |

(Continued)

*Primary Examiner* — Sue A Weaver
(74) *Attorney, Agent, or Firm* — Dean A. Craine

(57) ABSTRACT

A portable wardrobe storage and changing device for transporting uniforms and costumes to a performance site and then convert into a private changing station. The device includes a rigid internal frame with a lower frame and a perpendicularly aligned upward extending frame member. Attached to the lower frame are two wheels. Extending around the frame is a four-sided elongated bag with an adjustable upper lid. The elongated bag also includes a first vertical slide connector and a second horizontal slide connector that allows the bag to selectively opened or closed around the internal frame. Disposed between the lid and the elongated bag is a third slide connector that allows three edges of the lid to be selectively detached from the bag. When the three slide connectors are detached, the lid may be lifted and the two side panels and the two front panel sections maybe opened and extended to form a changing station.

20 Claims, 9 Drawing Sheets

U.S. PATENT DOCUMENTS

| | | | | |
|---|---|---|---|---|
| 5,790,992 | A * | 8/1998 | Ray | 4/599 |
| 5,842,495 | A | 12/1998 | Egnew et al. | 135/133 |
| 5,895,167 | A * | 4/1999 | Chang | 403/310 |
| 5,906,277 | A * | 5/1999 | Vienneau | 206/315.1 |
| 5,943,936 | A | 8/1999 | Deliman et al. | 90/115 |
| 6,021,794 | A | 2/2000 | Guerra | 135/95 |
| 6,179,176 | B1 | 1/2001 | Saggese et al. | 224/153 |
| 6,702,119 | B2 | 3/2004 | Sabounjian | 206/577 |
| 6,942,077 | B1 | 9/2005 | Nykoluk | 190/115 |
| 7,047,577 | B1 * | 5/2006 | Cirilli | 4/599 |
| 2002/0060510 | A1 * | 5/2002 | Choi | 312/6 |
| 2006/0054576 | A1 | 3/2006 | Durham | 211/85.7 |
| 2006/0283493 | A1 | 12/2006 | Charles | 135/121 |

* cited by examiner

PORTABLE STORAGE AND CHANGING STATION

This is a utility patent application which claims benefit of U.S. Provisional Application No. 60/932,388, filed on May 30, 2007.

BACKGROUND OF THE INVENTION

1. Field of the Invention

This invention pertains to portable containers used by athletes and entertainers to carry their uniforms and costumes to remote locations and more particularly, to have such containers that can be easily converted into a private changing station.

2. Description of the Related Art

Competitive ice skaters and dancers are, often required to change outfits in between performances. Often, the facility used for the competition does not have a sufficient number of private dressing rooms for all of the participants to use between performances. Normally, the participants find the nearest remote area then a coach or a parent holds up a blanket to shield the public from viewing the participant as he or she changes their outfits.

What is needed is a portable storage container that can conveniently hold a user's uniform or costume which also unfolds to act as a privacy screen to allow the user to privately dress and undress.

SUMMARY OF THE INVENTION

These and other objects are met by a portable wardrobe or uniform storage container and changing station disclosed herein that allows the user to easily transport uniforms, costumes and accessories used in a performance by the user to a remote competition site that can be easily converted into a private changing station. The device includes an internal rigid frame with a rigid lower frame and a perpendicularly aligned, upward extending, vertical frame member attached thereto. Attached to the opposite sides of the lower frame are two wheels that enable the device to be tilted and pulled or pushed like a hand truck over a flat surface. Also, attached to the lower frame are two short legs that enable the device to stand independently in a vertical, upright position on a flat horizontal surface. Disposed over the lower frame is an optional square or rectangular bucket.

Extending upward from the lower frame and around the vertical frame member is a lightweight, flexible four sided elongated bag. The bag includes a rear panel, two side panels and two front panel sections. Disposed over the top opening of the bag is a flexible lid which is sewn along its rear edge to the top edge of the rear panel. The two side edges and the front edge of the lid are selectively attached to the two side panels and the two front panel sections, respectively, via a connecting means, such as a slide connector. When the bag is closed, the two vertical edges of the two front panel sections are connected together via a second connecting means, such as a second slide connector. In the preferred embodiment, the lower edges of the two side panels and the two front panel sections are selectively attached to the side walls and front wall of the bucket, respectively, by a third connecting means, such as a third slide connector.

When the lower frame is placed on, the ground and the vertical frame member extends upward and all three connectors may be detached so that the two side walls and two front panel sections may be laterally extended. Simultaneously, the lid may be pulled upward so that the two triangular-shaped vent panels disposed between the side edges of the lid and the top edges of the side panels may act as visual barriers. Disposed around the top edge of the bag is a lightweight elastic, segmented rod which provides support to the top edges of the hag. Also, disposed inside the bag are two lid extension arms that, during setup, are diagonally positioned between the upper frame and the front corners of the lid to hold the lid in a diagonal forward extending position above the bag. The lengths of the extension arms are sufficient so that the two vent panels are fully extended to help support the extended side panels. Also, two optional extension cords may be used between the side edges of the lid and the two front panel sections to help support the two extended front panel sections.

Formed inside of the bag are optional pockets and hooks used to store items.

DESCRIPTION OF THE PREFERRED EMBODIMENT(S)

Figure 1:
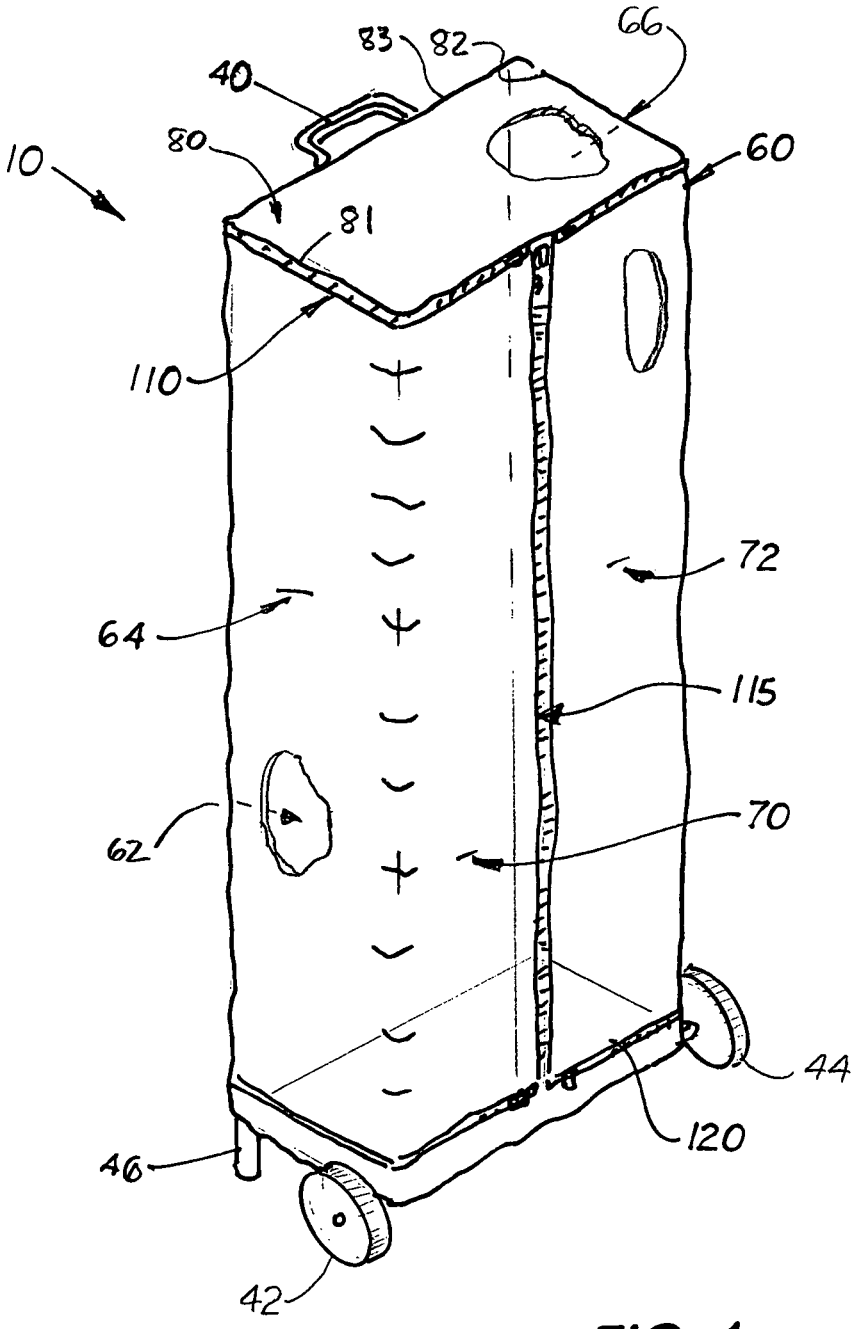
FIG. 1 is a perspective of a portable storage and changing device is a closed, transportable configuration.

Referring to the accompanying FIGS. 1-10, there is a portable wardrobe or uniform storage and changing device, hereinafter generally indicated by the reference number 10. The device 10 is designed to be configured into a closed structure shown in FIGS. 1 and 5 used to transport wardrobe items or configured into an opened structure used as a changing station shown in FIGS. 2-4. The device 10 is designed to hold wardrobe items generally indicated as 200, which may be placed on hangers 210 and hung from an internal rigid frame 20 or folded and placed into a bucket 50 or one of the side pockets 140 formed in the device 10.

The device 10 includes a pair of lower front wheels 42, 44 and an upper handle 40 located at opposite ends that enable the device 10 to be manually pulled or pushed over a flat surface similar to a hand truck.

Figure 6:
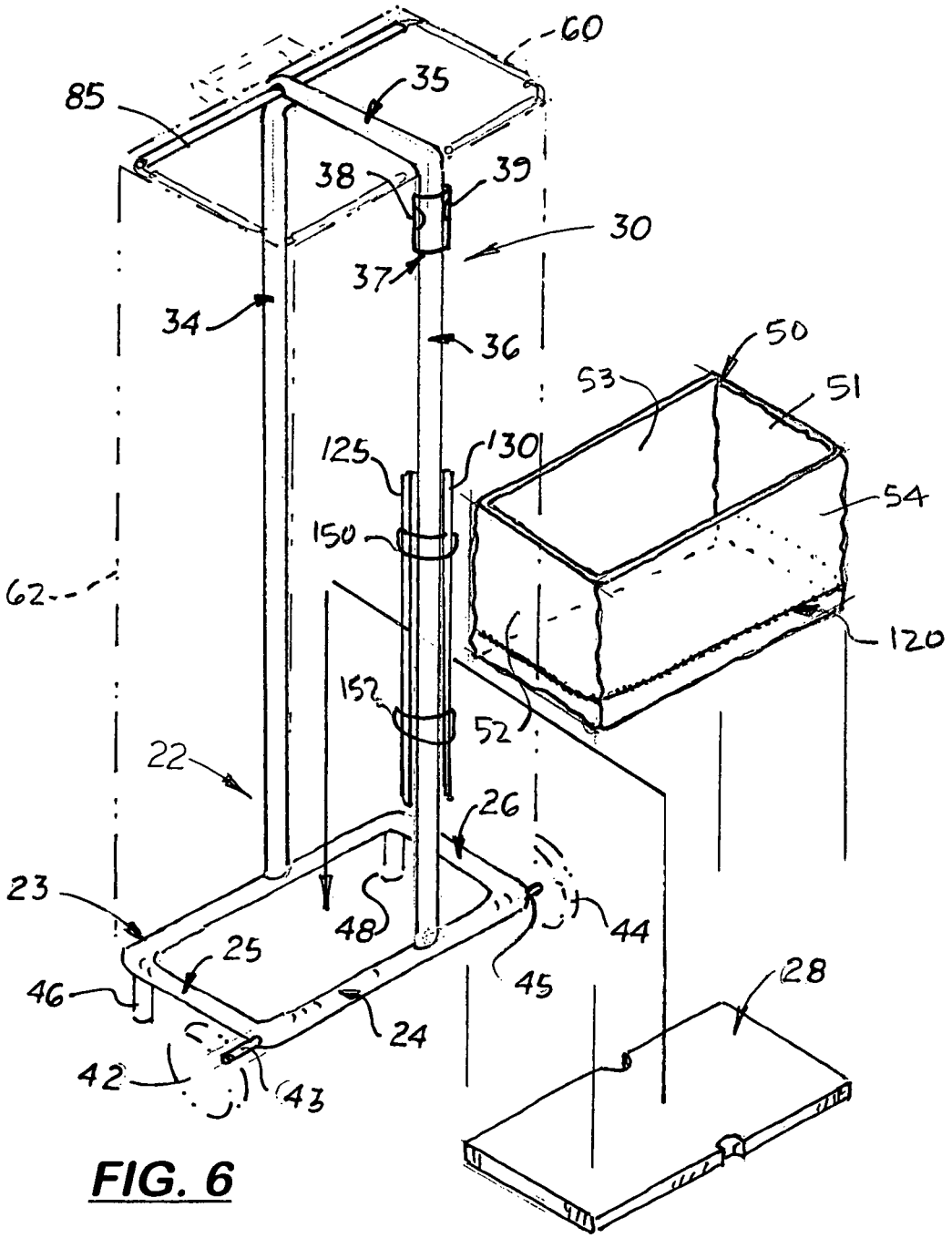
FIG. 6 is a perspective view of the rigid frame used in the portable storage and changing device.
Figure 7:
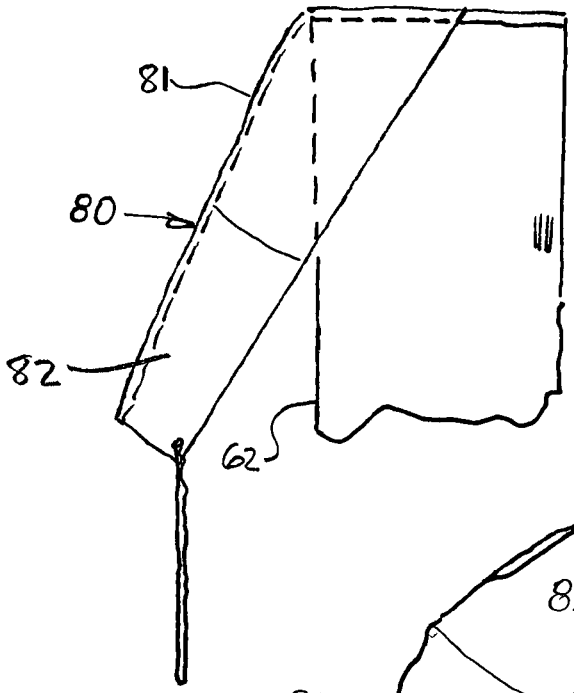
FIG. 7 is a partially side elevational view of the upper section of the device with the hood folded rearward and downward.
Figure 8:
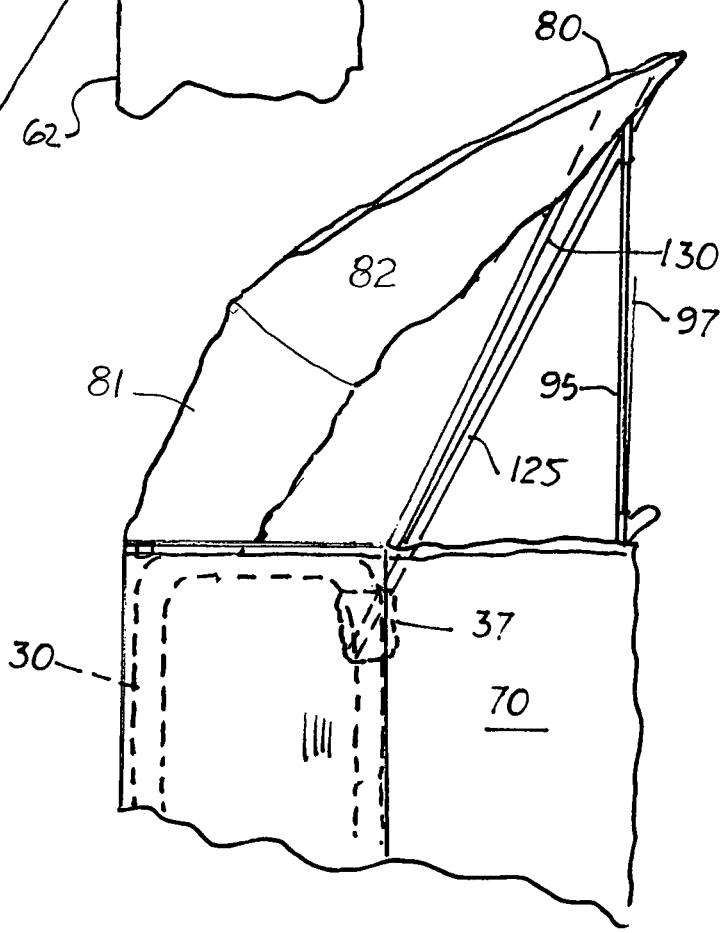
FIG. 8 is a partial side elevational view of the upper section of the device with the hood extended upward and forward.
Figure 9:
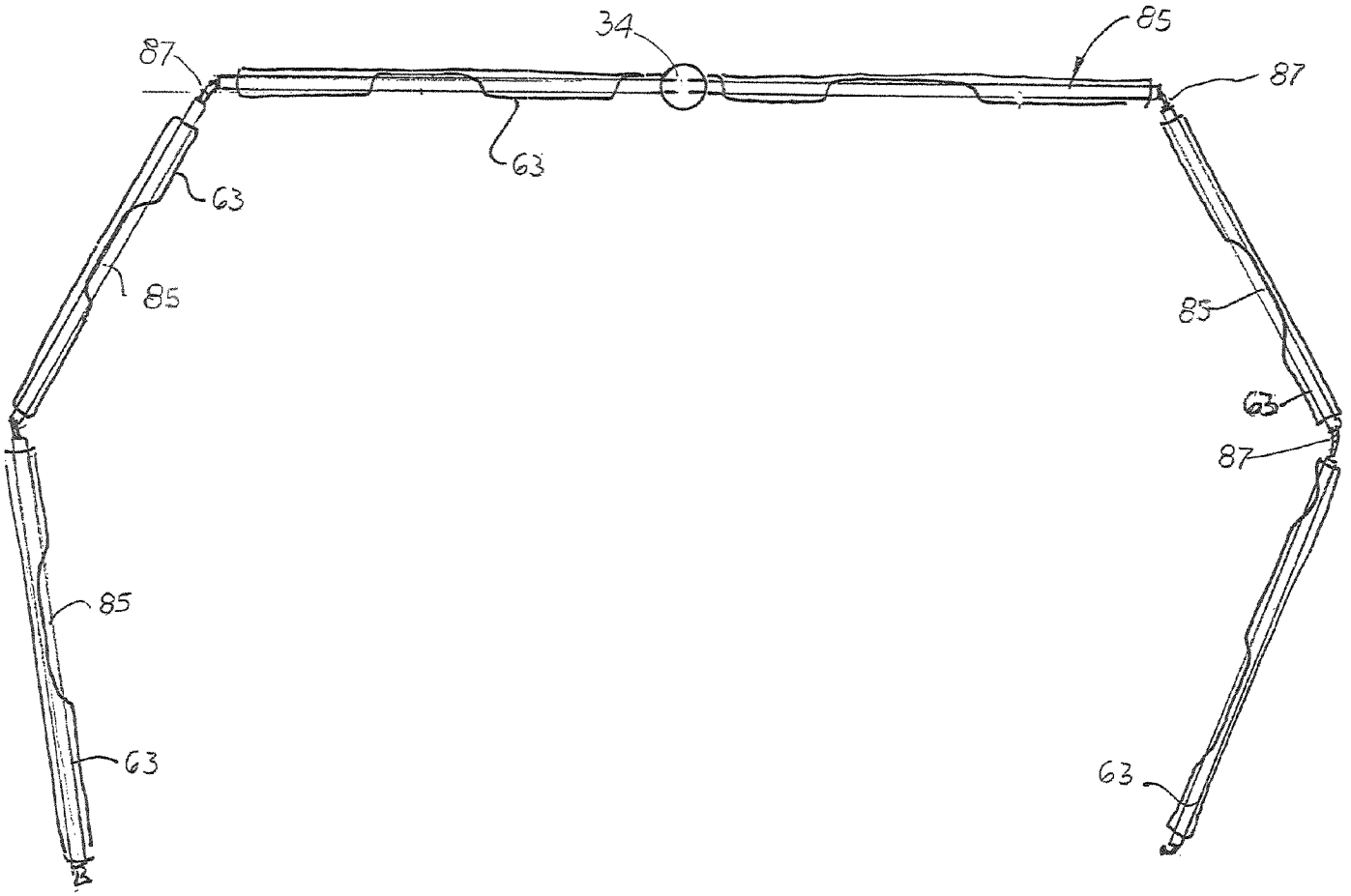
FIG. 9 is a top plan view of the elastic, segmented rod that fits along the upper section of the body.
Figure 10:
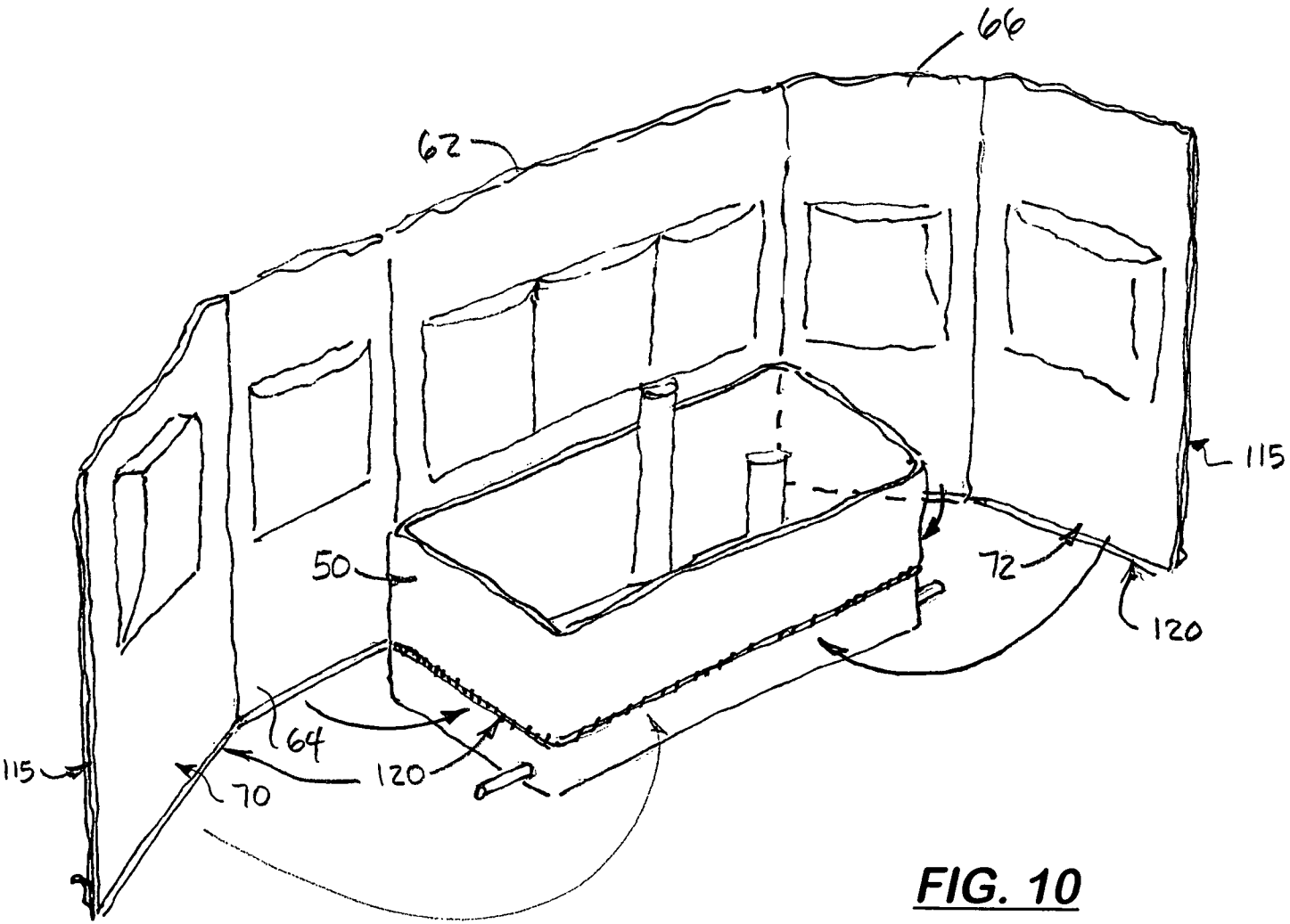
FIG. 10 is a partial perspective view of the body showing the two side panels and the two front panels being unfolded and laterally extended to expose the bucket and the inside pockets formed on the inside surfaces of the panels.

The device 10 includes a flexible, elongated bag 60 that wraps around a lightweight rigid frame 20 (shown more clearly in FIG. 6). The frame 20 includes a lower frame 22 with a central, perpendicularly aligned U-shaped frame member 30 attached thereto. In the preferred embodiment, the lower frame 22 is a rectangular structure that includes a rear member 23, a front member 24, and two side members 25, 26. Disposed transversely over the lower frame 22 is a flat rigid support panel 28. Attached to the opposite sides of the lower frame 22 near its front edge are two wheels 42, 44 that attach to two lateral extending axis 43, 45. Attached to the rear member 23 are two downward extending vertical legs 46, 48 that enable the device 10 to vertically stand upright on the flat surface.

Disposed around the lower frame 22 and extending upward from the support panel 28 is a lightweight square or rectangular-shaped bucket 50. In the preferred embodiment, the bucket 50 is rectangular in shape with two vertical side walls 51, 52, a vertical rear wall 53 and a front wall 54 each made of flexible material.

The frame member 30 includes a vertical rear support 34, a horizontal upper middle support 35, and a front support 36. The lower ends of the rear support 34 and front support 36 are securely attached to the lower frame's rear and front members 23, 24, respectively. Attached to the top section of the front support 36 is a flexible sleeve 37 with two side pockets 38, 39 formed therein that receive the lower ends of two extension arms 125, 130 discussed further below. As shown in FIG. 6, the two extensions arms 125, 130 are attached to the front support 36 via two straps 150, 152 when not in use.

The flexible, elongated bag 60 shown in FIGS. 1-5 which is designed to fit around the rigid frame 20 includes a rear panel 62, two side panels 64, 66, two front panel sections 70, 72 and a lid 80. Disposed along the side edges 81, 82 of the lid 80 and the upper edges of the two side panels 64, 66, respectively, and the two front panel sections 70, 72 is a first slide connector 110. When the bag 60 is closed, the two front panel sections 70, 72 are pulled transversely over the front open area of the bag 60 the over the front support 36 so that the two vertical edges of the two front panel sections 70, 72 may be connected together via a second slide connector 115. As shown in FIG. 6, disposed along the two side walls 51, 52 and front walls 54 of the bucket 50 is a third slide connector 120 which is used to connect the lower edges of the side panels 64, 66 and the lower edges of the two front panel sections 70, 72 to the walls 51, 52 and 54 of the bucket 50. When the first, second and third slide connectors 110, 115, 120, respectively, are attached, the bag 60 is closed as shown in FIG. 1 and mat be easily transported. When the first, second, and third slide connectors 110, 115, 120, respectively, are detached, the lid 80 may be lifted and the two side panels 64, 66 and the two front panel sections 70, 72 may be extended laterally to create an expanded changing station shown in FIGS. 2, 4 and 10.

Figure 2:
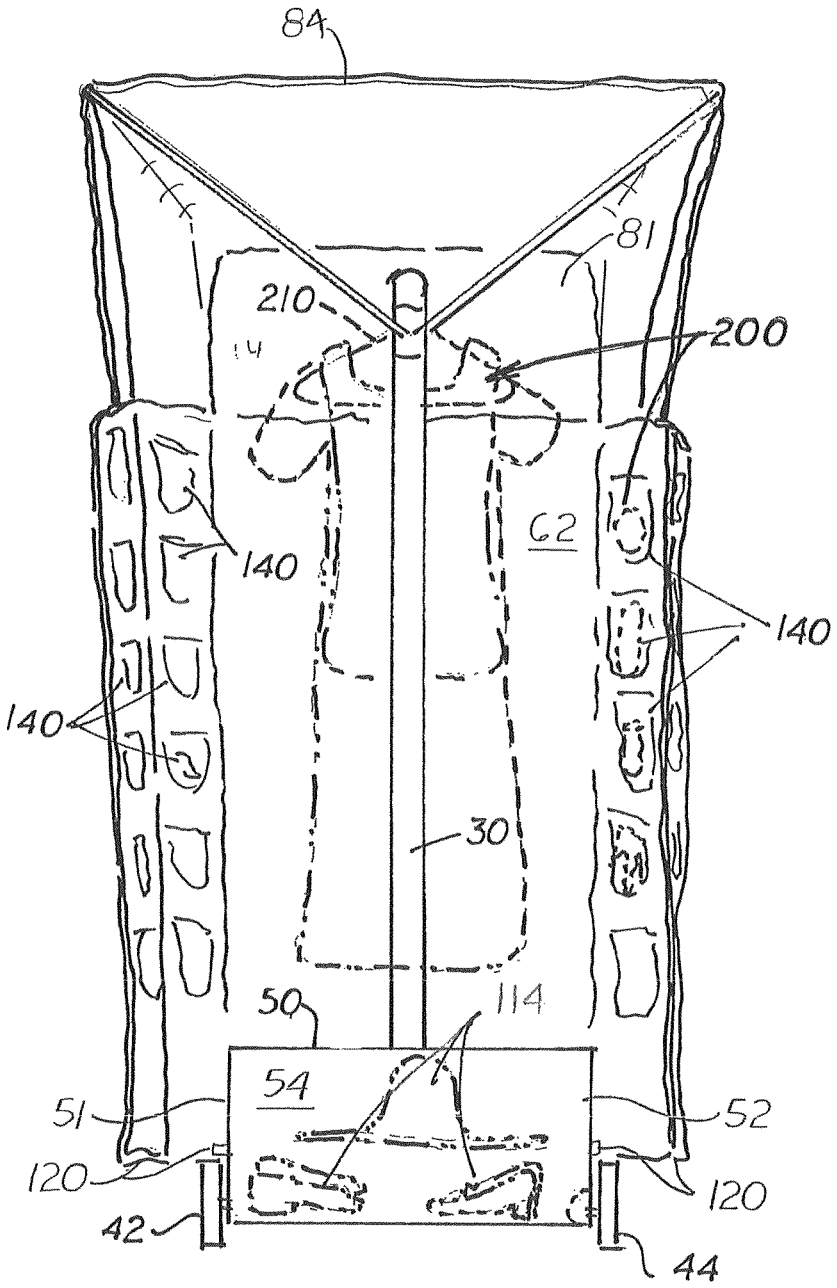
FIG. 2 is a front elevational view of the portable storage and changing device shown in an open, changing station configuration.
Figure 3:
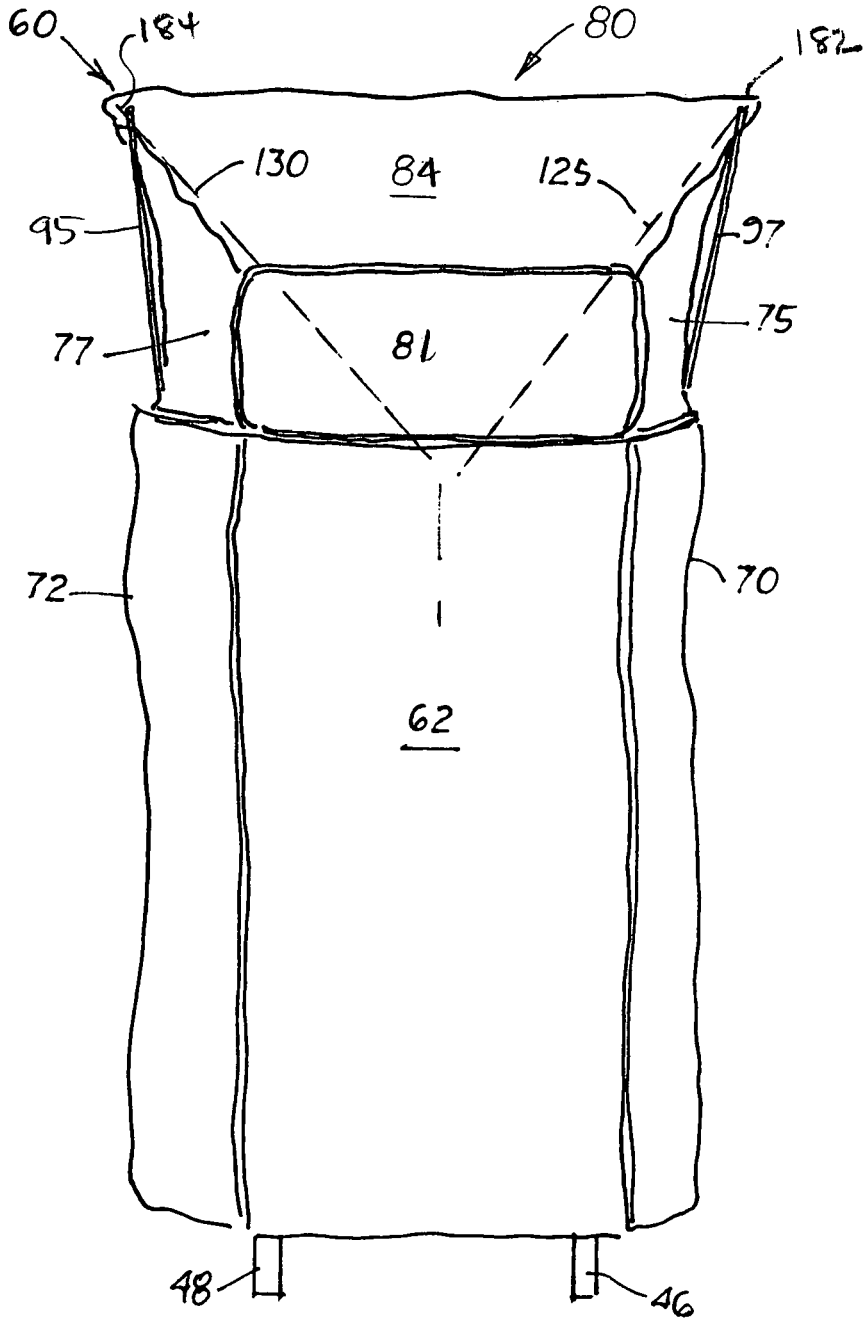
FIG. 3 is a rear elevational view of the portable storage and changing device shown in FIG. 2.
Figure 4:
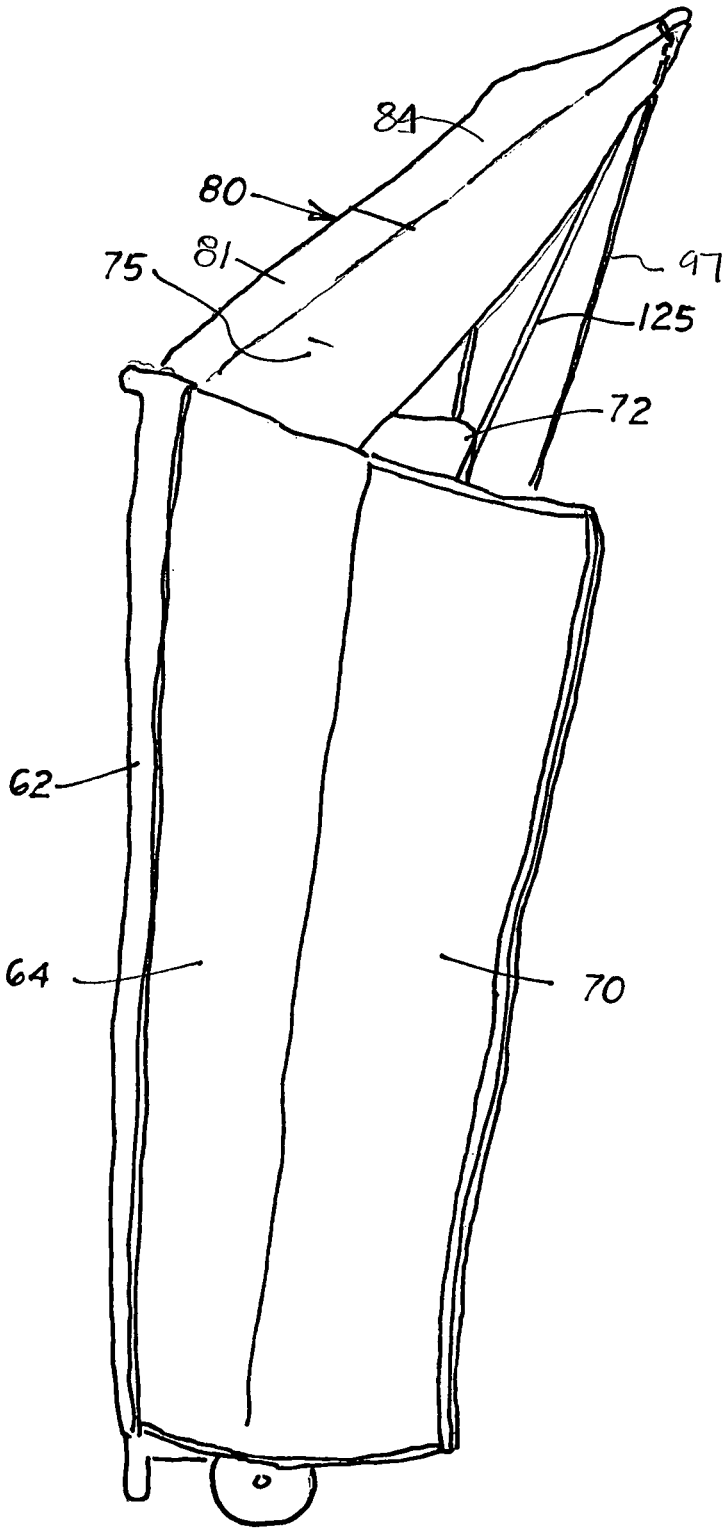
FIG. 4 is a side elevational view of the portable storage and changing device shown in FIGS. 2 and 3.
Figure 5:
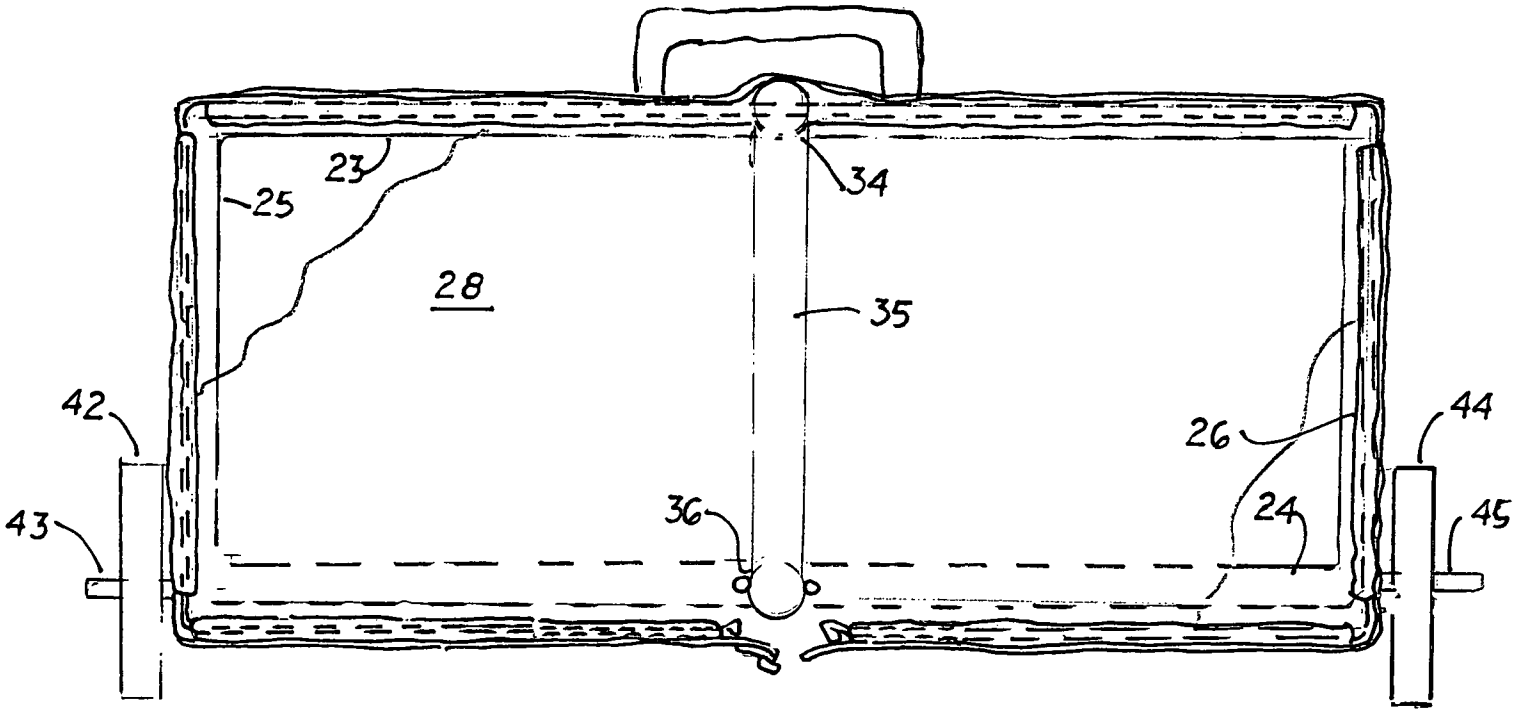
FIG. 5 is a top plan view of the portable storage and changing device in a closed, transportable configuration.

The rear end 83 of the lid 80 is sewn directly to the top edge of the rear panel 62. The lid 80 has sufficient length and width to cover the top opening of the device 10 when disposed in a bag configuration, as shown in FIG. 1. As shown in FIGS. 2-4, attached to the lid 80 is a forward extending flexible cover panel 84. When disposed in a bag configuration, the cover panel 84 folds backwards and under the lid 80. When used as a changing station, the lid 80 is pulled upward and the cover panel 84 is extended forward and upward from the front edge of the lid 80, as shown in FIG. 4.

Disposed between the side edges 81, 82 of the lid 80 and cover panel 84 and the top edges of the side panels 64, 66 are two triangular-shaped vent panels 75, 77 (see FIG. 3). When configured as a changing station, the vent panels 75, 77 extend forward and upward to act as visible shields and help to support the side panels 64, 66 when extended laterally.

As shown in FIG. 6, attached and perpendicularly aligned on the upper edge of the upper frame's rear support 34 is a rigid support rod 85 which is used to hold the upper edges of the rear panel 62 in an elevated position on the rear support 34. In the preferred embodiment, the support rod 85 is perpendicularly aligned with the rear support 34 and extends through a hole formed on the upper end of the rear support 34. In the preferred embodiment, small tubular seams 63 are formed around the upper perimeter edges of the rear panel 62, the two side panels 64, 66 and the two front panel sections 70, 72, respectively. During use, support rods 85 coupled together at joints 87 are inserted into the seams 63 so that the upper section of the bag 60 maintains a square or rectangular configuration.

Disposed inside the flexible hag 60 are two lid extension arms 125, 130 that are selectively extended diagonally upward between the frame 20 and the lid 80 to hold the front edges of the cover panel 81 in an upright forward position above the flexible bag 60 when used as a changing station. In the preferred embodiment, the lower ends of the lid extension arms 125, 130 engage two small pockets 38, 39 formed on a sleeve 37 attached to the front support 36. The upper ends of the two extension arms 125, 130 engage two small corner pockets 182, 184 formed on the front corners of the cover panel 84. Two extension straps 95, 97 extend between the upper edge of the lid 80 and the two front panels 70, 72 to apply downward forward on the lid 80 and to hold both front panels 70, 72 in a lateral and forward extending position.

Located on the inside surfaces of the two side panels 64, 66 and on the inside surfaces of the two front panel sections 70, 72 are a plurality of pockets 140.

In the preferred embodiment, the device 10 measures approximately 48 inches in length, 18 inches in width, and 9 inches in height. The bucket 50 measures approximately 18 inches in width, 9 inches in height and 7 inches in length. The lower frame 22 and the upper frame member 35 are made of PVC 1 inch O.D. tubing. The flexible bag 60 is includes an inner layer made of nylon and an outer layer made of polyester and nylon blend material. It should be understood that the bucket 50 and the side pockets 140 are optional and that all or some of the first, second and third slide connectors may be replaced by hook and loop tape connectors, buttons or snaps.

During use, the device 10 is opened and placed in an upright position so that the wardrobe items 200 needed for the performance may be packed into the device 10. As stated above, the wardrobe items 200 may be placed on hangers 210 and attached to the middle support 35. Non-hanging wardrobe items 144 may be folded and stored in the pockets 140 or placed in the bucket 50. Once all of the wardrobe items 144, 200 have been packed in the device 10, the two extension aims 125, 130 are detached from the lid 80 and connected to the frame 20 via elastic rings 152, 152 (see FIG. 6). The cover panel 84 and lid 80 are then closed and the two side panels 64, 66 and two front panel sections 70, 72 are also folded over and around the bucket 50 and the front support 36. The three slide connectors 110, 115, 120 are then used to close the flexible bag 60 into a transportable configuration shown in FIG. 1. The device 10 now filled with wardrobe items 144, 200 may then be transported to the performance site by pulling or pushing the device 10 via the handle 40.

Once arrived at the performance site, the device 10 is rolled to the desired location, such as the inside corner of the building so no one can see the user from behind. The device 10 is then placed in an upright position and the three slide connectors 110, 115, 120 are detached thereby enabling the two side panels 64, 66, the two front panel sections 70, 72, the cover panel 84, and the two side vents 75, 77 to be extended, as shown in FIGS. 2-4. The extension arms 125, 126 and elastic cords 95, 97 are attached from the frame 20 and placed between the cover panel 84 and the upper edges of the side panels 64, 66 and front panel sections 70, 72. The device 10 is now ready for use as a changing station.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A portable, wardrobe storage and changing device, comprising:

a. a rigid internal frame including a lower frame and at least one rigid vertical frame member perpendicular aligned and attached to said lower frame, said internal frame being sufficient in length to store a wardrobe item attached to a hanger;

b. a pair of wheels attached to said lower frame;

c. a bucket located adjacent to said lower frame on said internal frame, said bucket includes a vertical front wall, a vertical rear wall, and two opposite vertical side walls;

d. an elongated bag extending around said bucket and extending upward and enclosing said internal frame, said bag includes a rear panel, two side panels, two front panel sections, each said side panel includes a top edge and a lower edge and each said front panel section includes and upper edge, a lower edge, and a vertical edge, said side panels and said front panel sections are able to unfold and extended laterally from said internal frame thereby enabling a wardrobe item located in said bag to be easily removed and also act as a visible shield when a user is positioned adjacent to said internal frame and changing a wardrobe item;

e. a segmented rod located along said top edges of said side panels and said front panel sections that enable said top edges of said side panels and said upper edges of said front panel sections to be supported in an extended lateral position from said rear panel;

f. a flexible lid pivotally attached along one edge to said elongated bag, said lid includes a front edge and two side edges;

g. a means for selectively connecting said front edge and said side edges of said lid to said top edges of said side panels and said upper edges of said front panel sections;

h. a means for selectively connecting said vertical edges of said front panel sections together to hold said elongated bag is in a closed position around said bucket and said internal frame;

i. a means for selectively connecting said lower edges of said side panels and said lower edges of said front panel sections to said side walls to hold said elongated bag in a closed position around said bucket;

j. at least one pole extendable between said internal frame and said lid, said pole being sufficient in length to hold said front edge of said lid is an extended position above said internal frame thereby enabling said lid to act as an upper visible shield when standing adjacent to said internal frame and changing a wardrobe items; and, k. a handle enabling said elongated bag to be manually rolled over a flat surface.

2. The storage and changing device, as recited in claim 1, wherein said internal frame includes an upper horizontal frame member used by a hanger attached to a wardrobe item to hang said wardrobe item inside said elongated bag.

3. The storage and changing device, as recited in claim 2, further including a plurality of pockets on an inside surface of at least one side panel.

4. The storage and changing device, as recited in claim 2, wherein said means for selectively connecting said front edge and said side edges of said lid to said top edges of said side panels and said upper edges of said front panel sections is a slide connector.

5. The storage and changing device, as recited in claim 1, further including a plurality of pockets on an inside surface of at least one side panel.

6. The storage and changing device, as recited in claim 1, wherein said internal frame is made of lightweight tubing material.

7. The storage and changing device, as recited in claim 1, wherein said means for selectively connecting said front edge and said side edges of said lid to top edges of said side panels and said front panel sections is a slide connector.

8. The storage and changing device, as recited in claim 1, wherein said means for selectively connecting the two adjacent said vertical edges of said front panel sections together is a slide connector.

9. The storage and changing device, as recited in claim 1, further including at least one leg attached to and extended downward from said lower frame and supported a flat support surface to enable said device to stand upright.

10. The storage and changing device, as recited in claim 9, wherein said means for selectively connecting the said lower edges of said side panels and said front panel sections to said bucket is a slide connector.

11. The storage and changing device, as recited in claim 1, wherein said means for selectively connecting said lower edges of said side panel and said front panel sections to said bucket is a slide connector.

12. The storage and changing device, as recited in claim 1, wherein said lid includes a flexible front cover panel that can be unfolded and extended in an upward diagonal position when said lid is detached from said top edges of said side panels and from said upper edges of said front panel sections to create a visible shield.

13. The storage and changing device, as recited in claim 12, further including at least one extension arm disposed between said internal frame and said lid to hold said lid in an extended upward, diagonal position.

14. The storage and changing device, as recited in claim 12, further including two side vents that extend between the opposite said side edges of said lid to said top edges of said side panels when said lid is in an extended upward, diagonal position create a visible shield.

15. The storage and changing device, as recited in claim 12, further including at least one extension arm disposed between said internal frame and said lid to hold said lid in an extended upward, diagonal position above said bag.

16. The storage and changing device, as recited in claim 1, further including two side vents that extend between the opposite side edges of said lid to said top edges of said side panels when said lid is in an extended upward, diagonal position to create a visible shield.

17. A portable, wardrobe storage and changing device, comprising:

a. an elongated internal frame, with at least one upper horizontal frame member, said internal frame being sufficient in size to allow a wardrobe item on a clothes hanger to be hung from said horizontal frame member;

b. an elongated bag extended around said internal frame, said bag includes a rear panel, two folding side panels, two folding front section panels, said side panels include a top edge;

c. a lid pivotally attached along one edge to said rear panel of said elongated bag, said lid includes two side edges and a front edge;

d. a slide connector disposed between said side edges of said lid and said side panels and disposed between said front edge and said front section panels;

e. means for selectively connecting said front section panels together enabling said elongated bag to be selectively closed or opened;

f. two wheels attached to said internal frame enabling said elongated bag to be rolled across a surface;

g. means for selectively supporting said lid in an extended upward, diagonal position over said elongated bag; and, h. means for selectively supporting said side panels and said front section panels in opposite lateral extended positions from said elongated bag thereby enabling said device to acts as a changing station.

18. The storage and changing device, as recited in claim 17, wherein said lid further includes a flexible front cover that can be unfolded and extended from said lid to create a visible shield.

19. The storage and changing device, as recited in claim 18, further including two side vents that extend between said side edges of said lid and said top edges of said side panels to create a visible shield.

20. The storage and changing device, as recited in claim 17, further including two side vents that extend between said side edges of said lid and said top edges of said side panels of said elongated bag to create a visible shield.

* * * * *